US006205920B1

(12) United States Patent
Dzierzynski et al.

(10) Patent No.: US 6,205,920 B1
(45) **Date of Patent: *Mar. 27, 2001**

(54) CONTINUOUS IMAGE TRANSFER BELT AND VARIABLE IMAGE SIZE OFFSET PRINTING SYSTEM

(75) Inventors: Edward P. Dzierzynski, Asheville; Robert Andrew, Gastonia; Michael E. McLean, Waynesville, all of NC (US)

(73) Assignee: Day International, Inc., Dayton, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,662

(22) Filed: Sep. 24, 1998

(51) Int. Cl.[7] ..... B41F 5/16; B41F 5/18; B41F 7/02

(52) U.S. Cl. ..... 101/217; 101/177; 101/DIG. 48; 428/909

(58) Field of Search ..... 101/399, 212, 101/368, 279, 407.1, DIG. 33, DIG. 48, 177, 217; 428/909, 57, 80, 188, 221, 409; 442/247–252

(56) References Cited

U.S. PATENT DOCUMENTS

| | | | | |
|---|---|---|---|---|
| 1,840,009 | * | 1/1932 | Ball et al. . | |
| 2,036,451 | * | 4/1936 | Wood | 101/350 |
| 3,418,864 | * | 12/1968 | Ross | 74/232 |
| 4,002,791 | * | 1/1977 | Sawyer | 428/260 |
| 4,224,370 | * | 9/1980 | Heinemann | 428/246 |
| 4,708,059 | * | 11/1987 | Junghans | 101/350 |
| 4,770,928 | | 9/1988 | Gaworowski et al. . | |
| 4,981,750 | * | 1/1991 | Murphy et al. | 428/220 |
| 5,201,978 | * | 4/1993 | McCarten et al. | 156/154 |
| 5,390,597 | | 2/1995 | Hashimoto et al. . | |
| 5,410,392 | | 4/1995 | Landa . | |
| 5,456,171 | | 10/1995 | Biava et al. . | |
| 5,478,638 | * | 12/1995 | Springer et al. | 428/248 |
| 5,643,381 | | 7/1997 | Iwafune et al. . | |
| 5,727,471 | | 3/1998 | Iwafune et al. . | |
| 5,749,298 | | 5/1998 | Castelli et al. . | |
| 5,768,990 | | 6/1998 | Vrotacoe et al. . | |

FOREIGN PATENT DOCUMENTS

| | | |
|---|---|---|
| 396 168 | 5/1924 | (DE) . |
| 39 07 366 | 9/1990 | (DE) . |
| 44 42 983 | 6/1996 | (DE) . |
| 196 04 430 | 8/1996 | (DE) . |
| 0 225 509 | 6/1987 | (EP) . |
| 0 547 753 | 6/1993 | (EP) . |

* cited by examiner

*Primary Examiner*—Kimberly Asher
(74) *Attorney, Agent, or Firm*—Killworth, Gottman, Hagan & Schaeff, LLP

(57) ABSTRACT

A continuous image transfer belt which is useable in a variable image size offset press system and which is adapted to permit the press to print a variety of different sized printed matter is provided. The image transfer belt includes at least one base ply, at least one layer of a compressible material over the base ply, and a surface ply over the layer of compressible material Preferably, the belt is continuous. The belt is used in an offset printing system having the capability to print variable-sized images. The system includes a source of ink; at least one plate cylinder and a replaceable sleeve for the plate cylinder, and a printing plate which is adapted to receive ink from the ink source. The system also includes at least one blanket cylinder; the image transfer belt positioned to contact the printing plate in a nip formed between the plate and blanket cylinders; an image transfer belt tensioning system to register the image transfer belt to the blanket cylinder position in the area of desired image transfer; and an image belt cleaning station adapted to remove residual ink from the surface of the belt.

8 Claims, 3 Drawing Sheets

CONTINUOUS IMAGE TRANSFER BELT AND VARIABLE IMAGE SIZE OFFSET PRINTING SYSTEM

BACKGROUND OF THE INVENTION

This invention relates to an image transfer belt for use in a variable image size offset printing system, and more particularly to a continuous belt construction for transferring inked images from a variable size printing plate to a substrate.

In traditional offset printing processes, the printing press includes a plate cylinder or drum, a blanket cylinder, and an impression cylinder supported for rotation in the press. The plate cylinder carries a printing plate wrapped around the cylinder, which printing plate defines an image to be printed. The blanket cylinder carries a printing blanket having a flexible surface which contacts the printing plate in a nip between the plate cylinder and blanket cylinder. A web or substrate to be printed is passed through a nip between the blanket cylinder and impression cylinder. Ink is applied to the surface of the printing plate which transfers the inked image to the surface of the blanket at the nip between the plate and blanket cylinders. The inked image is then transferred (offset) to the web at the nip between blanket cylinder and impression cylinder.

Typically, the printing plate cylinder is of a fixed diameter, and the printing blanket cylinder is selected to match this diameter. This diameter fixes the maximum length of image which can be printed. Thus, typical offset presses provide printed matter having a fixed size. While smaller sized images may be transferred, this wastes space by leaving unprinted areas on the web, which unprinted areas must be discarded. Depending on the amount of space which is wasted, the economic costs may be substantial.

This waste factor has prevented offset printing press manufacturers from offering press designs that incorporate changeable plate cylinders having different diameters. Unless the blanket cylinder is also changed to match the plate diameter, the amount of wasted areas on the web will still be substantial. However, designing a press in which both the plate cylinder and blanket cylinder diameters are changeable significantly complicates the press design. Further, the labor and down time involved to change the press components adds further costs to the printer. Accordingly, these design limitations have to date restricted owners and users of offset press equipment from serving customers who have needs for various sizes of printed matter. Thus, there remains a need in this art for an offset press which can accommodate various sizes of printed matter without the waste associated with prior designs.

SUMMARY OF THE INVENTION

The present invention meets that need by providing a continuous image transfer belt which is useable in a variable image size offset press system and which is adapted to permit the press to print a variety of different sized printed matter. In accordance with one aspect of the present invention, an image transfer belt is provided and comprises at least one base ply, at least one layer of a compressible material over the base ply, and a surface ply over the layer of compressible material. Preferably, the belt is continuous. However, the belt may also be formed from a flat blanket which includes a seam.

The base ply of the belt forms a reinforcement layer which adds dimensional stability to the belt. The reinforcement material may be a woven fabric ply, a non-woven fabric ply, a polymeric material, a metal, or a spun filament or cord. The fabric, filament, and/or cord may be of either a synthetic polymer or natural material such as cotton. In one embodiment of the invention, the base ply comprises a woven fabric ply which is rigid in a direction across the width of the belt and flexible along the longitudinal axis of the belt. Preferably, the inner surface of the base ply is capable of providing precise registration of any image transferred to the working surface of the belt. The inner surface may be comprised of a high friction material or a material which has been treated or roughened to increase its frictional properties.

In another aspect of the invention, an offset printing system having the capability to print variable-sized images is provided and includes a source of ink; at least one plate cylinder and a replaceable sleeve for the plate cylinder, the replaceable sleeve adapted have mounted thereon a printing plate, the printing plate adapted to receive ink from the ink source; at least one blanket cylinder; an image transfer belt positioned to contact the printing plate in a nip formed between the plate and blanket cylinders; an image transfer belt tensioning system to register the image transfer belt to the blanket cylinder position in the area of desired image transfer; and an image belt cleaning station adapted to remove residual ink from the surface of the image transfer belt. In a preferred form, the belt tensioning system comprises a plurality of tensioning rolls about which the image transfer belt is driven. To control and enhance the dissipation of heat from the belt, at least one of the tensioning rolls may be temperature controlled. Further, to aid in proper image registration in the system, one or more sensing devices may be located to sense the position of the image transfer belt. Through proper feedback control techniques, the printed image may be maintained in proper registration.

Accordingly, it is a feature of the present invention to provide a continuous image transfer belt which is useable in a variable image size offset press system and which is adapted to permit the press to print a variety of different sized printed matter. This, and other features and advantages of the present invention, will become apparent from the following detailed description, the accompanying drawings, and the appended claims.

DETAILED DESCRIPTION OF THE PREFERRED EMBODIMENT

For purposes of this disclosure, an image transfer belt is a construction in which the circumference of the belt is greater than the circumference of any cylinder on which it is mounted. References to the "outer" surface of the image transfer belt mean the surface of the belt which contacts the printing plate and which transfers the inked image to the traveling web. References to the "inner" surface of the belt mean the opposite surface of the belt which is in contact with the blanket cylinder.

Figure 1:
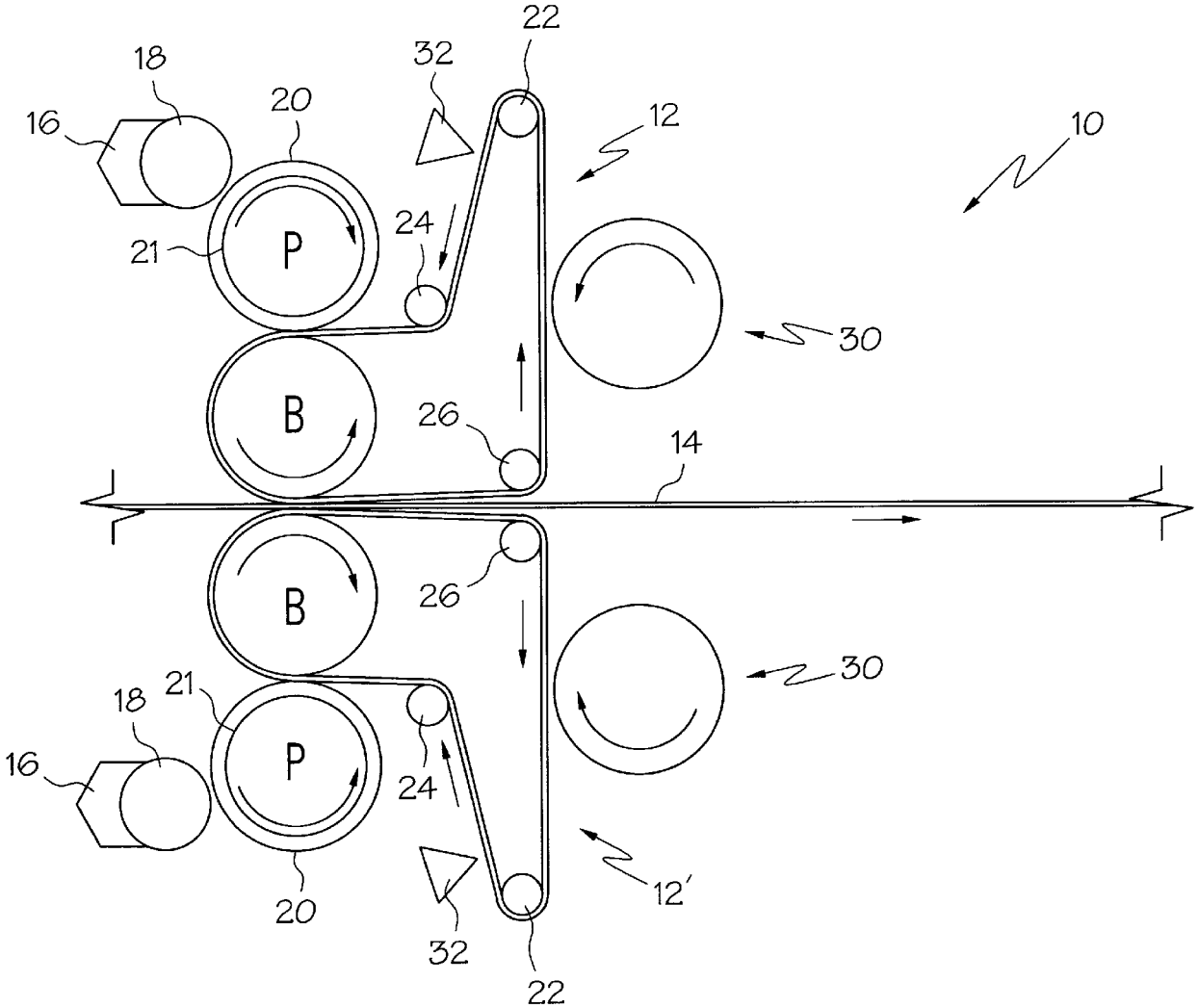
FIG. 1 is a schematic illustration of the invention showing an embodiment of the offset printing system with image transfer belt for a two-sided printing operation.

As shown schematically in FIG. 1, an offset printing system 10 includes a pair of image transfer belts 12 and 12' which are arranged for two-sided printing of a traveling web 14. While the invention will be described with reference to this preferred embodiment, it will be apparent to those skilled in the art that the system could be used for single-sided printing by replacing one of the image transfer belt assemblies with an impression cylinder (not shown). Further, while a specific belt path is illustrated for purposes of explanation, it will be apparent to those skilled in this art that various belt paths could be used in combination with various tension rolls to provide a path which is tailored to a specific press construction.

In the illustrated embodiment of the invention, as is conventional in the offset printing art, ink from an ink fountain 16 is transferred through one or more intermediate fountain/distributor rolls 18 to a printing plate 20 on a print cylinder P. However, it will be apparent that one may also use other types of inks including waterless inks and radiation curable inks, including UV or electron beam curable inks. Suitable ink transfer devices and printing plate surfaces are known to those in this art for such types of inks.

An advantage of the present invention is that the effective length of printing plate 20 may be modified by changing its circumference when mounted on plate cylinder P without the need to modify any other component in the system. Thus, a user of the system may readily change the size of printed images by simply changing the printing plate. For example, the printing plates used in the system may be mounted onto different diameter sleeves which can be changed as needed. Such sleeves could have a common internal diameter to match the outer diameter of the plate cylinder P while varying the external diameter using suitable structures.

An inked image is transferred to a respective image transfer belt 12, 12' from inked plate 20. The image transfer belt is mounted in an assembly which includes a drive means (not shown), a blanket cylinder B, and tension rolls 22, 24, and 26. The image transfer belts 12, 12' then in turn transfer (offset) the inked images simultaneously to opposite sides of traveling web 14. In the embodiment which is shown, the respective blanket cylinders B act as impression cylinders for each other. All of the cylinders and rolls are interconnected by gears and are rotated by a drive means in a known manner.

The system 10 also includes respective belt cleaning stations 30 which serve to remove any residual ink from the surface of the image transfer belts. Such cleaning stations may utilize either mechanical and/or chemical means to remove residual ink from the surface of belt 12. For example, suitable cleaning devices include mechanical brushes or liquid solvents for the inks. In the case of radiation curable inks, the cleaning station can include a radiation source to cure any ink on the belt surface to harden it, and then the cured ink can be removed,, for example, by mechanical brushing or scraping.

Sensors may also be used in the system to guide the belts 12 and 12' and to sense and maintain those belts in proper registration. For example, such sensors may include optical, mechanical, or pneumatic devices for sensing the edges of the belt. Optionally, a sensor may be used in conjunction with cleaning station 30 to sense when residual contamination on the surface of belt 12 is such that the belt should be replaced.

Figure 2A:
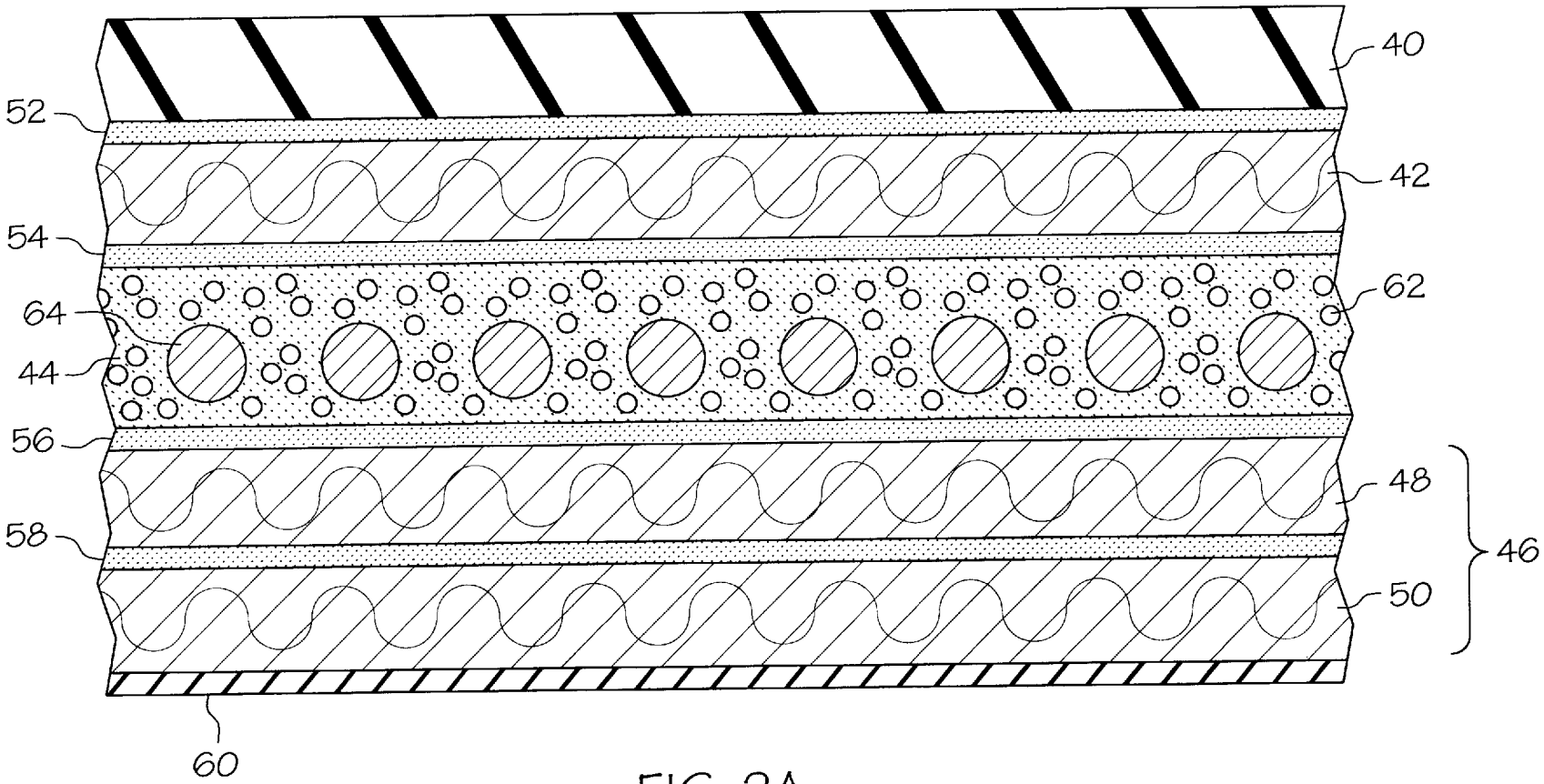
FIG. 2A is a sectional view of the layers which form the image transfer belt.

The image transfer belt 12 is preferably in the form of a continuous, gapless belt having an inner surface which is engaged in frictional contact with the outer surface of blanket cylinder B as well as with tension rolls 22 and 26, respectively. As shown in FIG. 2A, belt 12 comprises a plurality of layers including a surface ply 40, a reinforcing ply 42, a compressible layer 44, and a base ply 46. For purposes of illustration, base ply 46 includes two substrate fabric layers 48 and 50. Optionally, a friction-enhancing layer 60 may be present on the inner surface of the belt. Friction-enhancing layer 60 may be comprised of a polymer such as an elastomer which increases the frictional force between the inner surface of the belt and the underlying blanket cylinder and tension rolls to prevent any belt slippage and provide precise registration of the belt. Those skilled in the art will recognize that the number and types of plies, and their position in the belt construction, may be varied depending on the uses intended. Typically, the belt may be formed on a mandrel by applying the various layers in sequence.

Adhesive layers 52, 54, 56, and 58 are preferred to ensure sufficient bonding between the different plies of the belt. The adhesive layers may be any suitable elastomeric adhesive known in the art. Preferably, the adhesive will be a rubber cement. Reinforcing plies 42, 48, and 50 are preferably formed of woven or nonwoven fabric The fabric weave is preferably one in which there is only minimal extensibility in the warp direction (i.e., in the direction longitudinal to the machining of the belt). Further, it is preferred that the fabric be rigid across the width of the belt while being flexible along the longitudinal axis of the belt so that the belt will readily conform and flex to the shape of the tension rolls and blanket cylinder surfaces. Typically, the fabric is selected from high grade cotton yarns which are free of slubs and knots, rayon, nylon, polyesters, or mixtures thereof Compressible layer 44 is preferably made using the process described in Gaworowski et al, U.S. Pat. No. 4,770,928, the disclosure of which is incorporated by reference. Microspheres which form voids 62 in layer 44 may be of any of the materials described in the '928 patent. Additionally, the microspheres may be those which are commercially available under the trademark EXPANCEL 461 DE, from Expancel of Sundvall, Sweden. Such microspheres have a wall comprised of a copolymer of vinylidene chloride and acrylonitrile and contain a gaseous blowing agent such as isobutane.

As shown in FIG. 2A, compressible layer 44 is comprised of a seamless tubular body of elastomeric material which further includes a compressible helically-wound thread 64 extending through the layer. By way of example, thread 64 may be spun onto base ply 46 and then uncured compressible elastomeric material forming layer 44 may be applied, such as by knife coating, onto the spun thread. In another alternative method of forming compressible layer 44, thread 64 is impregnated with the same elastomeric material which comprises layer 44. Thread 64 is then wound using the procedure as described in Vrotacoe et al, U.S. Pat. No. 5,768,990, the disclosure of which is incorporated by reference. Preferably, the belt is designed so that thread 64 is wound so that it is ideally positioned on a neutral axis of the blanket substantially at the mid-point of the thickness of belt 12.

Surface ply 40 is also a seamless, gapless layer of natural or synthetic rubber which is curable or vulcanizable. Suitable polymeric materials include natural rubber, styrene-butadiene rubber (SBR), ethylene/propylene/non-conjugated diene terpolymer (EPDM), butyl rubber, butadiene, acrylonitrile rubber, and polyurethanes. Preferably, the elastomer chosen is resistant to the solvents and inks which will be encountered during printing.

Figure 2B:
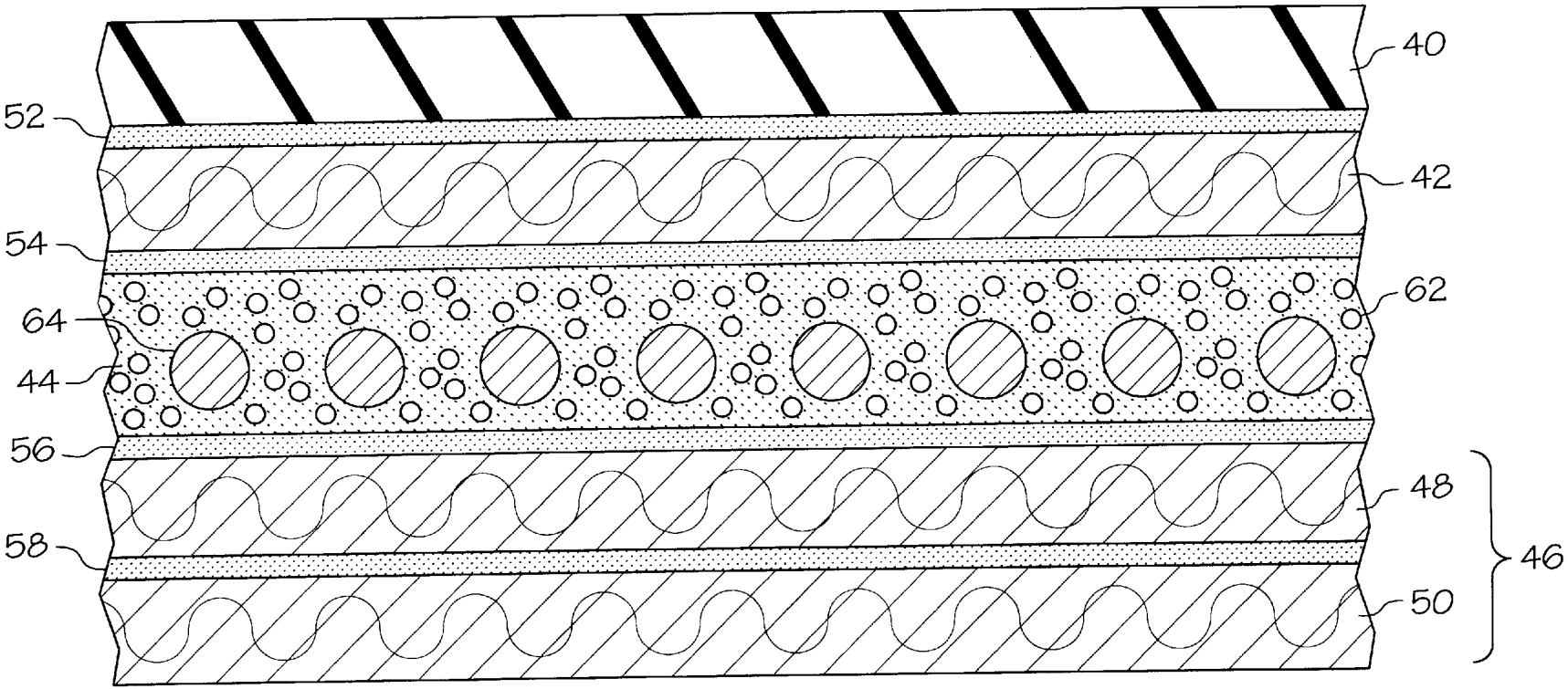
FIG. 2B is an alternative embodiment of FIG. 2A.

FIG. 2B illustrates an alternative embodiment in which the friction-enhancing layer 60 is not present.

The image transfer belt of the present invention has numerous advantages including the ability to print images of varying sizes without complicating the design of the press. Further, the belt has a useful life which is greater than a standard printing blanket or printing sleeve because it is a multiple of the length of a standard blanket Thus, the belt reduces down time and labor costs because it does not need to be replaced as often as a standard blanket.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An image transfer belt comprising: at least one base ply including a friction-enhancing inner surface comprised of an elastomer, at least one layer of a compressible material over said base ply, and a surface ply over said layer of compressible material, said belt being continuous.

2. An image transfer belt as claimed in claim 1 in which said base ply comprises a reinforcement material.

3. An image transfer belt as claimed in claim 2 in which said reinforcement material comprises a woven fabric ply.

4. An image transfer belt as claimed in claim 3 in which said woven fabric ply is rigid in a direction across the width of said belt and flexible along the longitudinal axis of said belt.

5. An image transfer belt as claimed in claim 1 in which said layer of compressible material includes a compressible helically-wound thread extending through said layer.

6. An image transfer belt as claimed in claim 5 in which said compressible helically-wound thread is positioned on a neutral axis of said belt substantially at the mid-point of the thickness of said belt.

7. An image transfer belt comprising: at least one base ply including a friction-enhancing inner surface comprised of an elastomer, a reinforcing ply over said base ply, at least one layer of a compressible material, and a surface ply over said layer of compressible material, said belt being continuous.

8. The image transfer belt of claim 7 wherein said reinforcing ply comprises a woven or nonwoven fabric.

* * * * *

UNITED STATES PATENT AND TRADEMARK OFFICE

CERTIFICATE OF CORRECTION

PATENT NO. : 6,205,920 B1
DATED : March 27, 2001
INVENTOR(S) : Dzierzynski et al.

It is certified that error appears in the above-identified patent and that said Letters Patent is hereby corrected as shown below:

Title page, item [57],
Abstract, "compressible material Preferably," should be -- compressible material. Preferably, --

Column 3,
Line 52, "removed,," should be -- removed, --

Column 4,
Line 19, "nonwoven fabric" should be -- nonwoven fabric. --
Line 28, "mixtures thereof" should be -- mixtures thereof. --

Column 5,
Line 4, "standard blanket" should be -- standard blanket. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*